US006943491B2

(12) United States Patent
Yamauchi et al.

(10) Patent No.: US 6,943,491 B2
(45) Date of Patent: Sep. 13, 2005

(54) PICTURE TUBE DEVICE HAVING LEAD ELECTRODE WITH A CURVED SHAPE

(75) Inventors: Masahide Yamauchi, Kyoto (JP); Takashi Itoh, Amagasaki (JP); Koji Fujii, Kashihara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/340,160

(22) Filed: Jan. 9, 2003

(65) Prior Publication Data

US 2003/0132695 A1 Jul. 17, 2003

(30) Foreign Application Priority Data

Jan. 15, 2002 (JP) ..... 2002-006511

(51) Int. Cl.[7] ..... H01J 29/58; H01J 29/48
(52) U.S. Cl. ..... 313/447; 313/409; 313/414
(58) Field of Search ..... 313/446, 409, 313/412–414, 447, 452, 309–311, 495, 497, 336, 351; 315/169.1, 382, 169.3; 445/6

(56) References Cited

U.S. PATENT DOCUMENTS 4,063,128 A * 12/1977 Hughes ..... 313/409
4,298,818 A * 11/1981 McCandless ..... 313/417
4,736,133 A * 4/1988 Barbin et al. ..... 313/414
4,818,914 A * 4/1989 Brodie ..... 315/169.3
5,122,135 A 6/1992 Dürr et al.
5,336,973 A * 8/1994 Leroux et al. ..... 315/14
5,874,802 A 2/1999 Choi et al.
5,898,183 A 4/1999 Teder
5,981,303 A 11/1999 Gilton
6,313,815 B1 11/2001 Takeda et al.
6,394,871 B2 5/2002 Lee
6,417,016 B1 7/2002 Gilton et al.

FOREIGN PATENT DOCUMENTS

| | | |
|---|---|---|
| JP | 48-90467 | 11/1973 |
| JP | 5-12986 | 1/1993 |
| JP | 9-240880 | 8/1997 |

* cited by examiner

*Primary Examiner*—Karabi Guharay
(74) *Attorney, Agent, or Firm*—Hamre, Schumann, Mueller & Larson, P.C.

(57) ABSTRACT

In a picture tube device with a field-emission cold cathode, including a plurality of electron-emitting cathodes, and a lead electrode provided with a plurality of apertures surrounding the plurality of electron-emitting cathodes respectively, a surface of the lead electrode has a curved shape that is convex in an electron emission direction. This makes it possible to obtain a high-resolution and high-performance picture tube device that has an excellent focus performance over an entire beam current.

6 Claims, 10 Drawing Sheets

PICTURE TUBE DEVICE HAVING LEAD ELECTRODE WITH A CURVED SHAPE

BACKGROUND OF THE INVENTION

1. Field of the Invention

The present invention relates to a picture tube device including a field-emission cold cathode.

2. Description of Related Art

A field-emission cold cathode uses an electron-emitting material at room temperature unlike a hot cathode, which heats an electron-emitting material at a high temperature ranging from 750° C. to 1000° C. Therefore, a picture tube device including such a field-emission cold cathode does not have a problem of electron emission caused by barium evaporation, which is often problematic in the hot cathode.

FIG. 8 illustrates a conventional example of a picture tube device including a field-emission cold cathode (JP 9(1997)-204880 A). Numeral 31 denotes an electron gun, which includes a triode portion 32 formed of a field-emission cold cathode (also referred to as a field emitter array) 25, a first electrode 26 and a second electrode 27, and a main lens portion 28 for focusing an electron beam emitted from the field-emission cold cathode 25. The first electrode 26, the second electrode 27 and the main lens portion 28 have an aperture for allowing an electron beam to pass through.

FIG. 9 illustrates a configuration of the field-emission cold cathode 25. As shown in this figure, the field-emission cold cathode 25 includes a concave upper electrode 36, a plurality of electron-emitting electrodes 35 and a lower electrode 33 that is connected electrically to the electron-emitting electrodes 35. In the upper electrode 36, a sunken bottom portion of the concavity is provided with a plurality of apertures surrounding the electron-emitting electrodes 35 respectively, while a raised portion of the concavity surrounds the region where the plurality of apertures are formed (an emitter region). Numeral 34 denotes an insulating layer for electrically insulating the lower electrode 33 and the upper electrode 36 from each other. The upper electrode 36 is connected electrically to the first electrode 26 (see FIG. 8).

An electric field formed by the upper electrode 36 and the electron-emitting electrodes 35 forces the emission of electrons in the electron-emitting electrodes 35 as an electron beam, which forms a crossover 24 between the first electrode 26 and the second electrode 27 due to an electrostatic lens effect as shown in FIG. 10. Thereafter, the electron beam passes through the main lens portion 28, and forms a beam spot on a phosphor screen 18 (see FIG. 8).

In the field-emission cold cathode 25, by mounting the electron-emitting electrodes 35 more densely, it is possible to increase the beam current density, which is an electron emission amount per unit area of the cathode. Furthermore, it is to be expected that a technology will be developed for achieving a higher resolution of the picture tube device by utilizing the high beam current density characteristics and reducing a beam spot diameter.

The higher-density mounting of the electron-emitting electrodes 35 is realized by a microfabrication technique of a semiconductor process. With this technique, it is possible to increase the beam current up to at least about five to ten times as great as that in the picture tube using the conventional hot cathode.

However, when the beam current is increased, the current density at the crossover 24 increases and causes the electrons to repel one another by a space charge repulsion, leading to an increase in the beam spot diameter.

Moreover, when the beam current is changed for brightness modulation, for example, the crossover 24 is displaced, causing a so-called focus tracking.

SUMMARY OF THE INVENTION

It is an object of the present invention to solve the above-described problems of the conventional technology and to provide a high-resolution and high-performance picture tube device that achieves an excellent focus performance over an entire beam current.

In order to achieve the above-mentioned object, a picture tube device of the present invention includes a plurality of electron-emitting cathodes, and a lead electrode provided with a plurality of apertures surrounding the plurality of electron-emitting cathodes respectively. Further, a surface of the lead electrode has a curved shape that is convex in an electron emission direction.

DESCRIPTION OF THE PREFERRED EMBODIMENTS

The surface of the lead electrode of a field-emission cold cathode of the picture tube device of the present invention has a curved shape that is convex in an electron emission direction. This prevents the beam spot diameter from increasing due to the electron repellence by the space charge repulsion at the crossover and prevents the focus tracking from occurring due to the displacement of the crossover. Thus, a high-resolution and high-performance picture tube device having an excellent focus performance over an entire beam current can be obtained.

Also, since there is no need for forming the crossover 24 as in the conventional technology, an entire length of the electron gun can be reduced, thereby achieving a thinner picture tube device.

In the picture tube device of the present invention, it is preferable that the surface of the lead electrode is formed into a substantially spherical surface, or its radius of curvature in at least one direction selected from a vertical direction and a horizontal direction may be made smaller from a center of the surface of the lead electrode toward a periphery thereof.

This compensates for the spherical aberration of the main lens, thus suppressing an increase in the beam spot diameter. Consequently, the resolution of the picture tube device improves further.

Furthermore, in the picture tube device of the present invention, it is preferable that the surface of the lead electrode is a cylindrical surface.

In this manner, the beam spot achieves a shape corresponding to an index phosphor screen, so that a high-resolution and high-performance picture tube device having an excellent focus performance can be obtained.

The following is a description of embodiments of the present invention, with reference to the accompanying drawings.

First Embodiment

Figure 1:
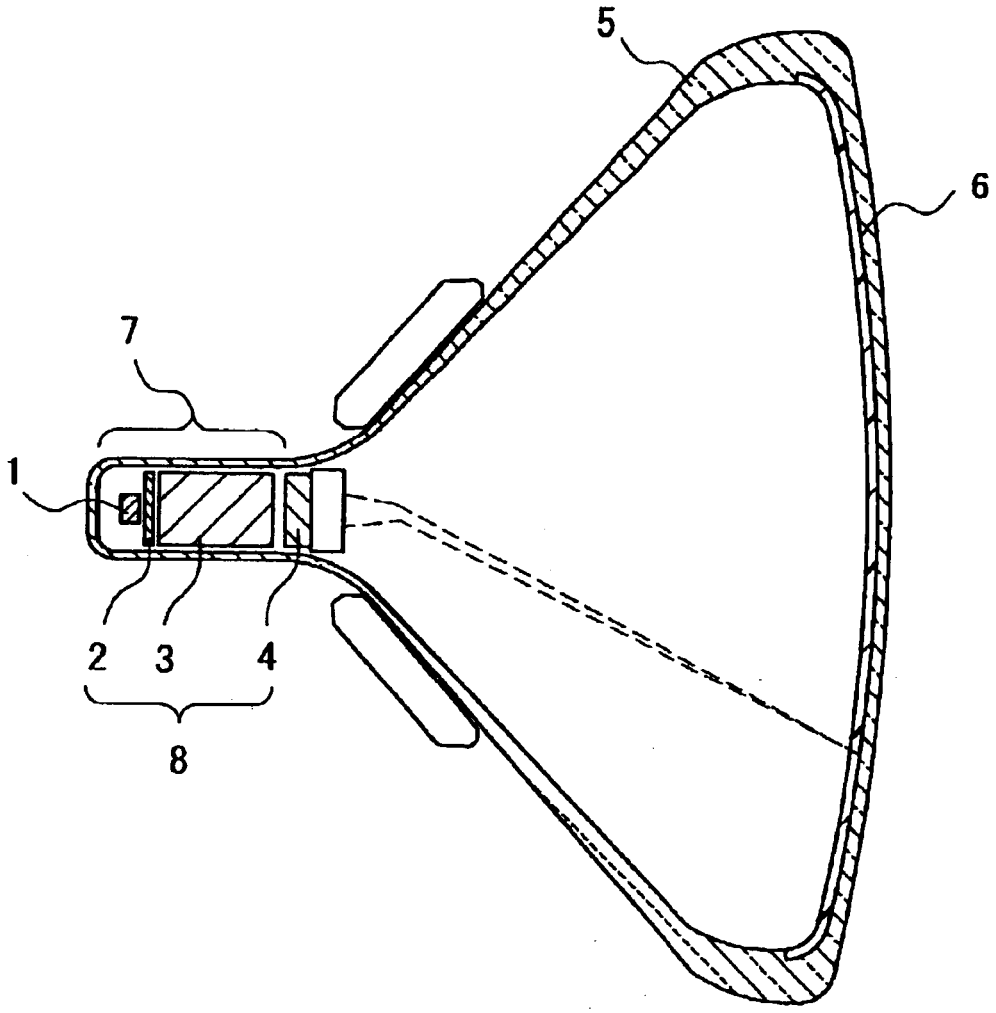
FIG. 1 is a sectional view showing schematically a picture tube device according to a first embodiment of the present invention.

As shown in FIG. 1, a picture tube device in accordance with the present embodiment includes a glass envelope 5 having a neck portion 7. In the neck portion 7, an electron gun 8 is sealed. A phosphor screen 6 is formed on an inner surface of a screen portion of the glass envelope 5. The electron gun 8 includes a cathode structure 1, a pre-focusing electrode 2, a focusing electrode 3 and a final accelerating electrode 4. The pre-focusing electrode 2 and the focusing electrode 3 have an aperture for allowing an electron beam generated from the cathode structure 1 to pass through.

Figure 2:
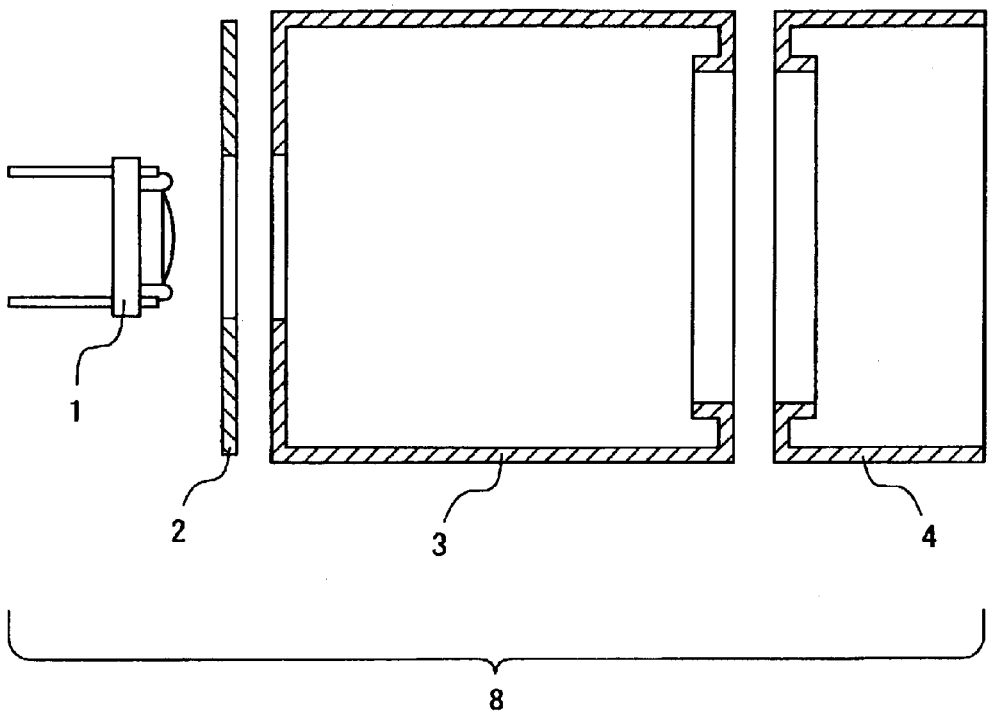
FIG. 2 is an enlarged sectional view showing an electron gun in the first embodiment of the present invention.

FIG. 2 is an enlarged sectional view of the electron gun 8. In the illustrated example, the pre-focusing electrode 2 has a thickness of 0.35 mm, and its aperture diameter is 3.2 mm. In the illustrated example, an electrode of the focusing electrode 3 on the side of the pre-focusing electrode 2 has a thickness of 0.35 mm, and its aperture diameter is 4.5 mm. The distance between the pre-focusing electrode 2 and the focusing electrode 3 may be 0.7 mm. The distance between a vertex of the cathode structure 1 and the pre-focusing electrode 2 may be 0.27 mm. The distance from the center of a gap between the focusing electrode 3 and the final accelerating electrode 4 to the vertex of the cathode structure 1 may be 23.5 mm. All of these electrodes may be formed of stainless steel. Further, in this example, during an operation of the electron gun 8, voltages of 4.25 kV, 7.5 kV and 30 kV are applied to the pre-focusing electrode 2, the focusing electrode 3 and the final accelerating electrode 4, respectively. In the present embodiment, the configuration, material and shape of each electrode and the voltage to be applied thereto can be changed suitably according to the size, application and required performance of the picture tube device.

Figure 3:
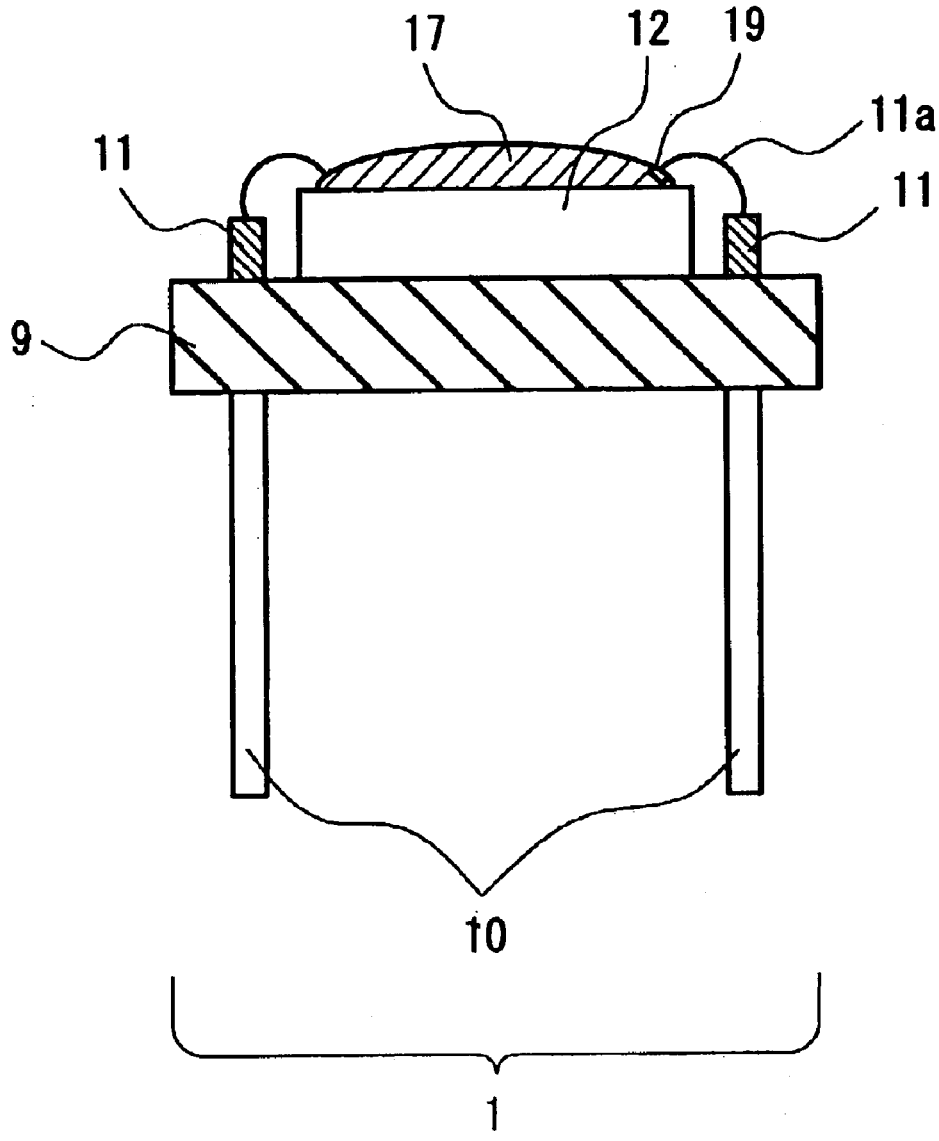
FIG. 3 shows a schematic configuration of a cathode structure in the first embodiment of the present invention.

FIG. 3 shows a schematic configuration of the cathode structure 1. The cathode structure 1 mainly includes a cathode 12, a lead electrode 17 for discharging electrons from the cathode 12 and an insulating substrate 9 for electrically insulating the cathode from an external part. The cathode 12 is provided with a bonding terminal 19, which is connected to a voltage supply terminal 11 via a conductor wire 11*a* having a diameter of 15 $\mu$m by ball bonding. The voltage supply terminal 11 is connected electrically to a voltage supply lead 10.

Figure 4:
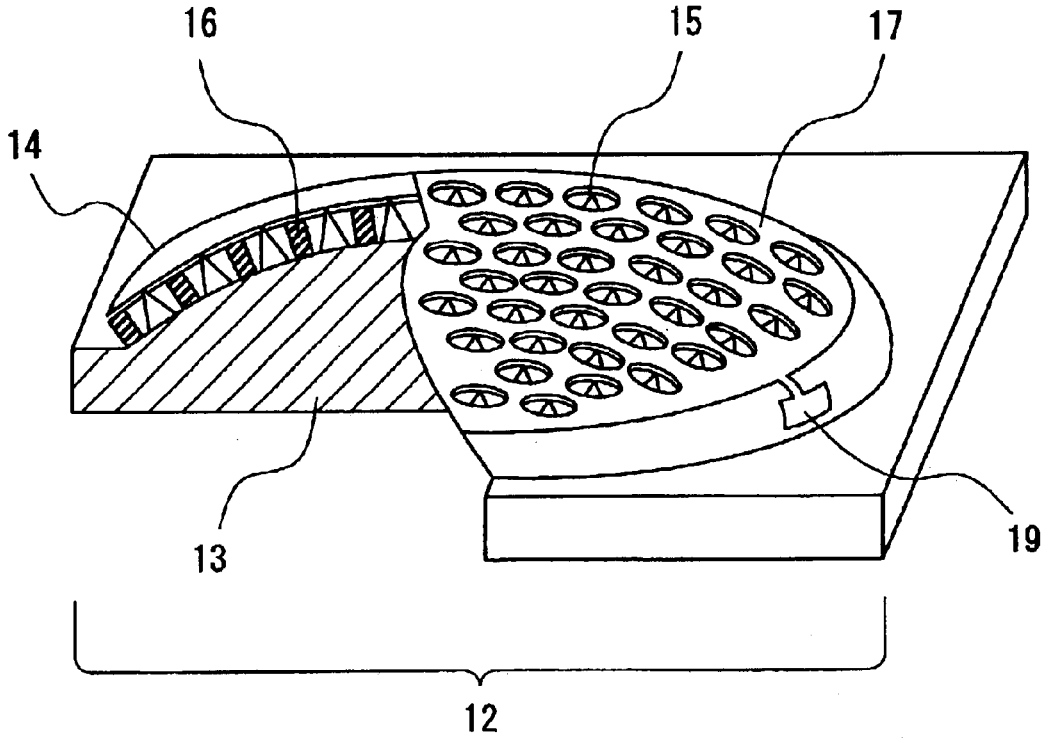
FIG. 4 is a perspective sectional view showing a cathode in the first embodiment of the present invention.

FIG. 4 is a perspective sectional view of the cathode 12. The cathode 12 mainly includes a substrate 13 and an emitter sheet 14. The emitter sheet 14 includes a plurality of electron-emitting electrodes 15, an insulating layer 16 formed on the substrate 13 so as to be spaced away from the electron-emitting electrodes 15, and the lead electrode 17. The insulating layer 16 electrically insulates the substrate 13 and the lead electrode 17 from each other. The lead electrode 17 is provided with a plurality of apertures surrounding the electron-emitting electrodes 15 respectively. On the lead electrode 17, a region where the plurality of apertures are formed is referred to as an emitter region. The surface of the lead electrode 17 is formed to have a curved shape that is convex in an electron emission direction. The electron-emitting electrodes 15 have a substantially cone shape, whose central axis corresponds to a line normal to a virtual surface within the emitter region of the lead electrode 17 at an intersection of this central axis and the virtual surface. Here, the virtual surface means a virtual curved surface that is complemented so that the surface of the lead electrode 17 at the edge of the apertures surrounding the electron-emitting electrodes 15 continues in these apertures. In addition, during an operation of the electron gun, a constant voltage of about 85 V is applied to the lead electrode 17 via the bonding terminal 19, while a voltage of 10 to 50 V is applied to the electron-emitting electrodes 15.

The cathode 12 may have an outer shape of 2 mm×2 mm and a maximal thickness of 0.5 mm. The plane shape of the emitter region seen from a tube axis direction may be circular and have a diameter of 1.1 mm. The surface of the lead electrode 17 is a part of a spherical surface and may have a radius of curvature of 10 mm. The bonding terminal 19 may be formed at a distance of about 0.1 mm from an end face of the cathode 12 and have a dimension of 0.2 mm×0.2 mm. The tips of the electron-emitting electrodes 15 may be processed to have a radius of about 10 nm. About 10000 apertures may be formed within the emitter region of the lead electrode 17 and each has a diameter of 0.8 $\mu$m, and the distance between an edge of each aperture and the electron-emitting electrode 15 may be 2 $\mu$m. The substrate 13 and the electron-emitting electrodes 15 may be formed of silicon (Si), the insulating layer 16 may be formed of silicon oxide ($SiO_2$), the lead electrode 17 may be formed of polysilicon, and the bonding terminal 19 may be formed of aluminum (Al).

The cathode 12 shown in FIG. 4 can be manufactured by the following method, for example. First, the electron-emitting electrodes 15, the insulating layer 16, the lead electrode 17 and the bonding terminal 19 are formed on a silicon substrate by a microstructure fabrication technique to which a semiconductor fabrication process is applied. Next, a back surface of this silicon substrate is abraded to obtain a thin sheet. In another process, a substrate whose one surface has a predetermined convex curved portion is prepared. The thin sheet silicon substrate is mounted and attached onto this curved portion, thus obtaining the cathode 12.

For operating the electron gun 8 with the above-described configuration, first, when 50 V is applied to the electron-emitting electrodes 15 of the cathode structure 1 while applying about 85 V to the lead electrode 17, no electron is emitted from the electron-emitting electrodes 15, which is called a cut-off state. Then, when the voltage applied to the electron-emitting electrodes 15 is lowered gradually, the electric field formed by the lead electrode 17 and the electron-emitting electrodes 15 intensifies, so that electrons are emitted from the electron-emitting electrodes 15. The emission amount of these electrons increases when the relative electric potential of the lead electrode 17 is raised by lowering the voltage applied to the electron-emitting electrodes 15. At this time, substantially the same amount of electrons is emitted from each of the electron-emitting electrodes 15 in the emitter region, and the current density is substantially uniform over the entire emitter region.

Figure 5:
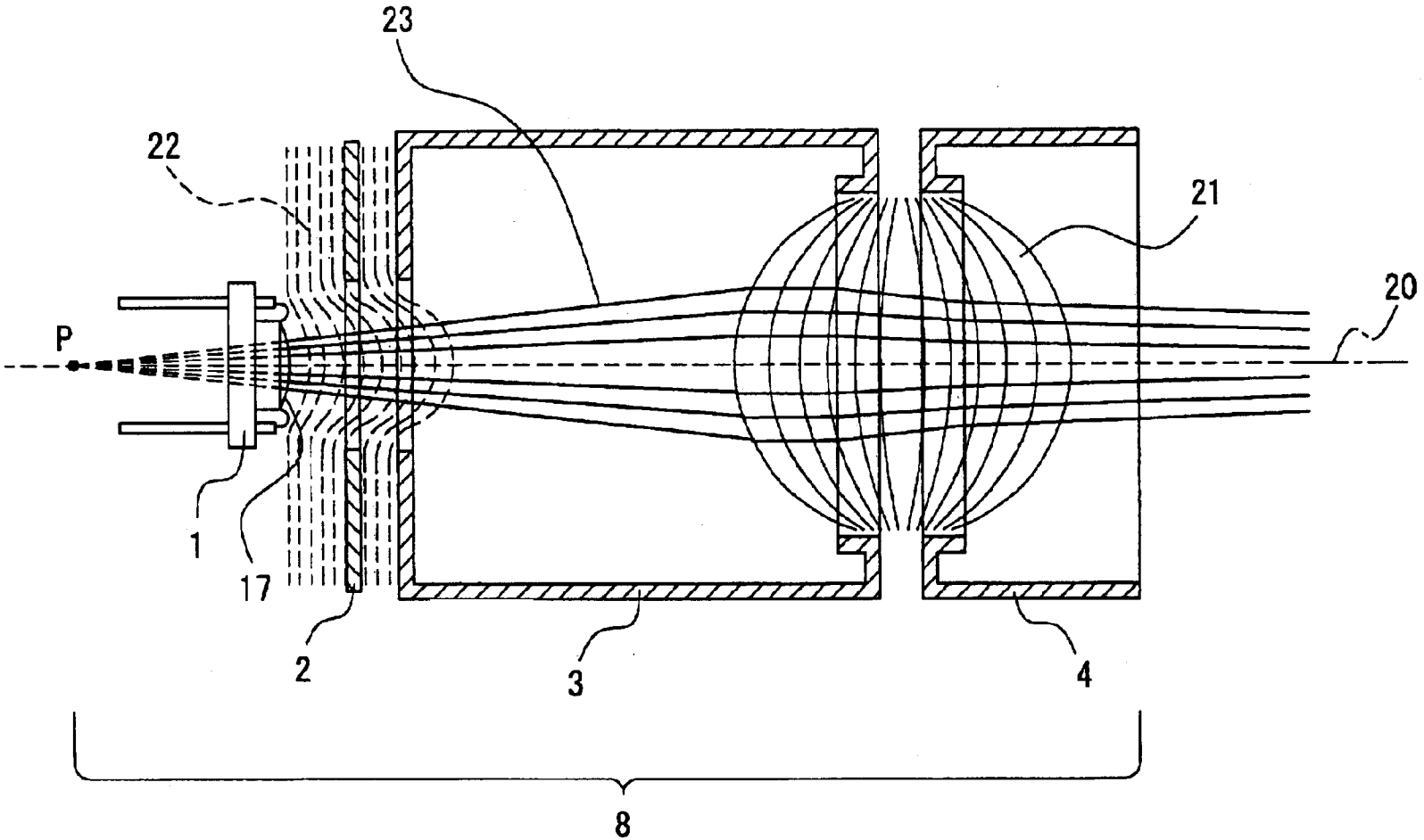
FIG. 5 is a sectional view showing how the electron gun is operated in the first embodiment of the present invention.

FIG. 5 shows an electric field distribution formed in the electron gun 8. Numeral 21 denotes a main lens, which is formed between the focusing electrode 3 and the final accelerating electrode 4. An effective aperture of the main lens 21 is about 10 mm. In the vicinity of the cathode structure 1, an equipotential surface 22 is formed along the surface shape of the lead electrode 17. Numeral 20 denotes a tube axis, which indicates a central axis of the picture tube device.

As shown in FIG. 5, electron beams 23 emitted from the emitter region of the lead electrode 17 are led in the normal direction of the surface of the lead electrode 17 by the electric field formed by the electron-emitting electrodes 15 of the cathode structure 1 (see FIG. 4), the pre-focusing electrode 2, the focusing electrode 3 and the final accelerating electrode 4. In FIG. 5, the electron beams 23 indicated by solid lines each show a main beam flux of an angle of 0° among electrons emitted symmetrically from the electron-emitting electrode 15 in such a manner as to diverge within an angle range of about ±25°. In the present embodiment, since the surface of the lead electrode 17 has a curved shape that is convex in the electron emission direction, the electron beams 23 emitted from the emitter region form a larger angle with respect to the tube axis 20 as their emitting positions are closer to a peripheral portion of the emitter region. The electron beams 23 are focused by the main lens 21 and then impact on the phosphor screen 6 (see FIG. 1) so as to form a beam spot (not shown).

Figure 10:
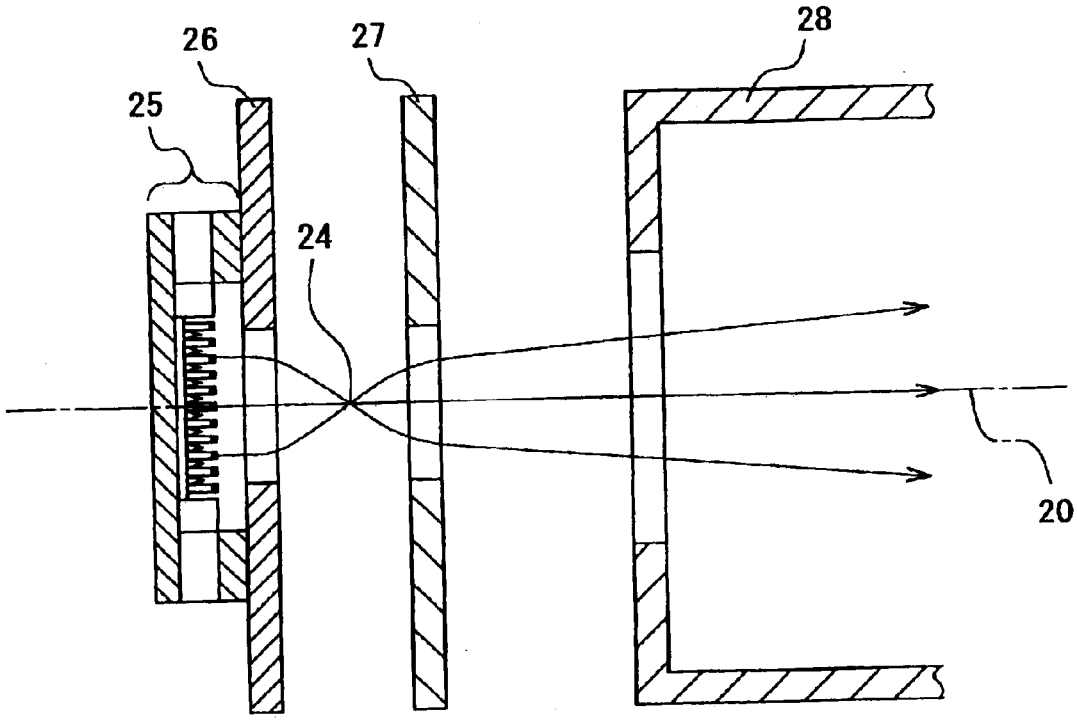
FIG. 10 PRIOR ART
FIG. 10 is an enlarged sectional view showing how an electron gun is operated in the conventional technology.

In the conventional technology, since an object point whose image point is the beam spot on the phosphor screen 6 corresponds to the crossover 24 (see FIG. 10), when the beam current is increased, the electrons repel one another at the crossover 24 by the space charge repulsion, leading to an increase in the diameter of the beam spot formed on the phosphor screen 6. Moreover, when the beam current is changed for brightness modulation, for example, the space charge repulsion varies, so that the crossover 24 is displaced, causing the focus tracking.

On the other hand, in the present embodiment, an object point whose image point is the beam spot on the phosphor screen corresponds to a point P, which is an intersection of the tube axis 20 and a line obtained by extending paths of the electron beams 23 toward the cathode, as shown in FIG. 5. However, this is just a virtual point, which means that no electron is present at this point, so no repellence of electrons occurs. Furthermore, since the point P does not move even when the beam current is changed in the present embodiment, the beam spot is formed on the phosphor screen accurately, thus causing no focus tracking.

In accordance with the present embodiment, it is possible to suppress the increase in the diameter of the beam spot formed on the phosphor screen. Furthermore, since no focus tracking occurs even when the beam current is changed, it is possible to reduce the diameter of the beam spot over the entire beam current. Consequently, the resolution of the picture tube device can be improved considerably compared with that of the conventional technology.

Although the picture tube device in the present embodiment is a so-called monochrome picture tube device, which includes only one cathode structure, the technological concept of the present embodiment also can be applied to a color picture tube device. In that case, three cathode structures for blue, green and red are provided, and generally, a shadow mask for color selection is provided so as to face the phosphor screen 6 shown in FIG. 1.

Second Embodiment

Figure 6:
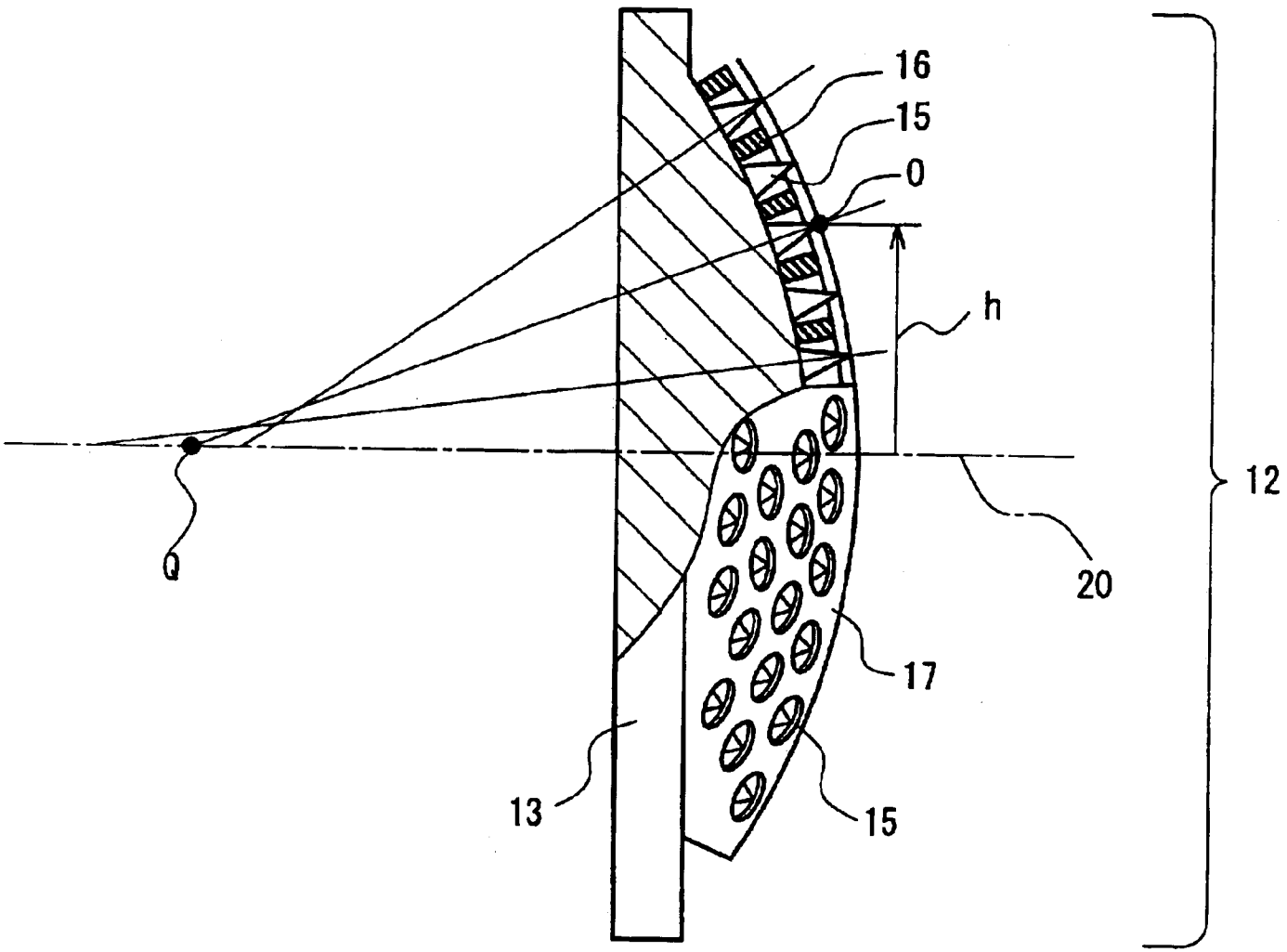
FIG. 6 shows a schematic configuration of a cathode in a second embodiment of the present invention.

A picture tube device in accordance with the present embodiment is obtained by changing the radius of curvature of the surface (the convex curved surface) of the lead electrode 17 of the first embodiment. More specifically, the radius of curvature of the surface is constant in the first embodiment, while the radius of curvature of that surface is made smaller from the center of the lead electrode 17 (in this case, a point through which the tube axis 20 passes) toward the periphery thereof in the present embodiment. In other words, as shown in FIG. 6, when Q indicates an intersection of the tube axis 20 and the normal line of the surface of the lead electrode 17 at an arbitrary point O of this surface, the lead electrode 17 is designed so that the intersection Q approaches the side of the lead electrode 17 as a distance h from the tube axis 20 to the point O increases, i.e., as the point O shifts toward the peripheral portion of the lead electrode 17. In this configuration, the central axis of each of the electron-emitting electrodes 15 corresponds to the line normal to the surface of the lead electrode 17 at the intersection of this central axis and the surface, as in the first embodiment.

Since the electron beams emitted from the peripheral portion of the emitter region of the lead electrode 17 usually pass through a peripheral portion of the main lens 21 (see FIG. 5), the electron beams are each subjected to a greater focusing force and form an image on a side closer to the electron gun 8, so that the beam spot diameter increases. On the other hand, according to the present embodiment, since the radius of curvature of the surface of the lead electrode 17 is made smaller from the center of the lead electrode 17 toward the periphery thereof, it is possible to correct the great focusing force applied to the electron beam emitted from the peripheral portion of the emitter region, thereby reducing the above-described spherical aberration of the main lens 21. Compared with the first embodiment, this effect further can suppress the tendency that the beam spot diameter increases, thus achieving a still higher resolution of the picture tube device.

Third Embodiment

A picture tube device in accordance with the present embodiment is obtained by replacing the cathode 12 in the first embodiment with a cathode 37 having a different shape.

Figure 7:
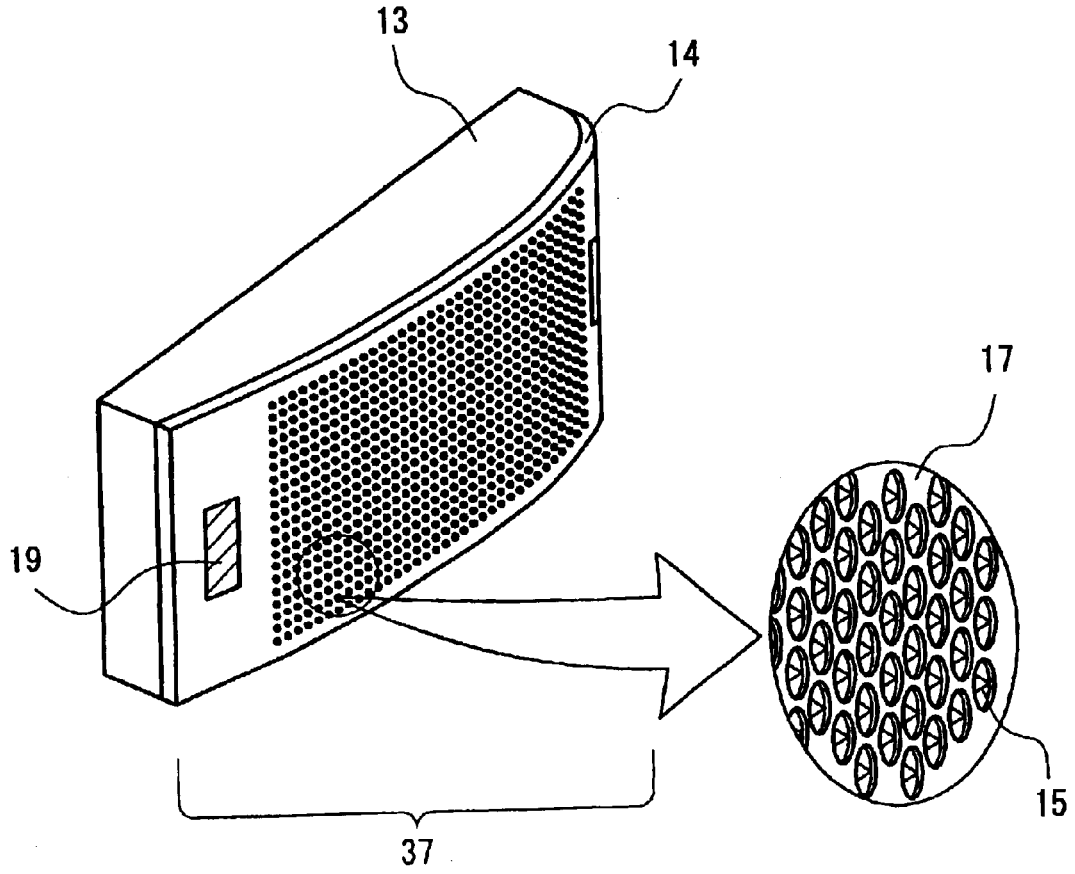
FIG. 7 shows a schematic configuration of a cathode in a third embodiment of the present invention.
Figure 8:
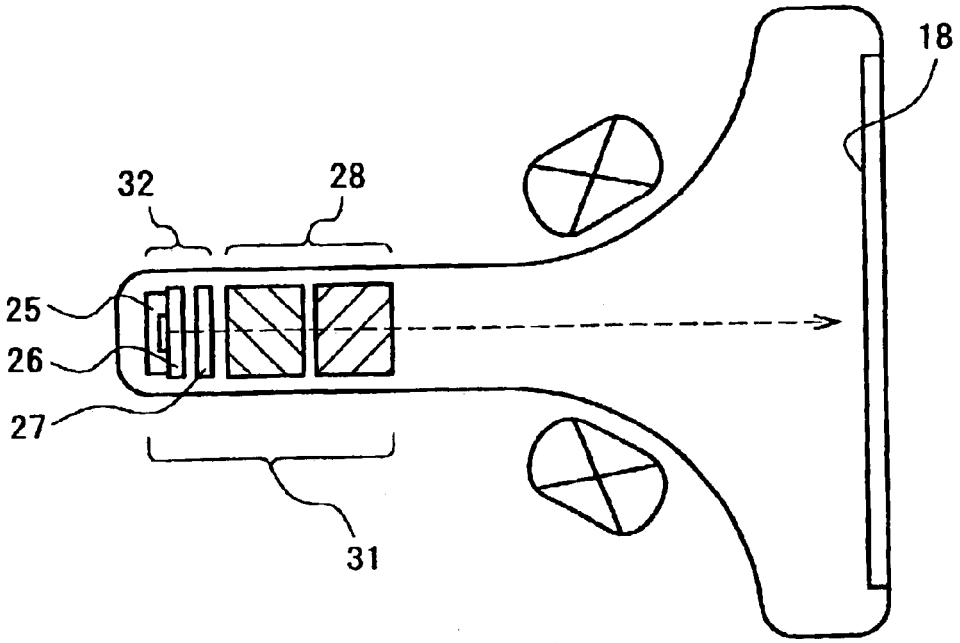
FIG. 8 PRIOR ART
FIG. 8 is a sectional view showing schematically a picture tube device according to a conventional technology.
Figure 9:
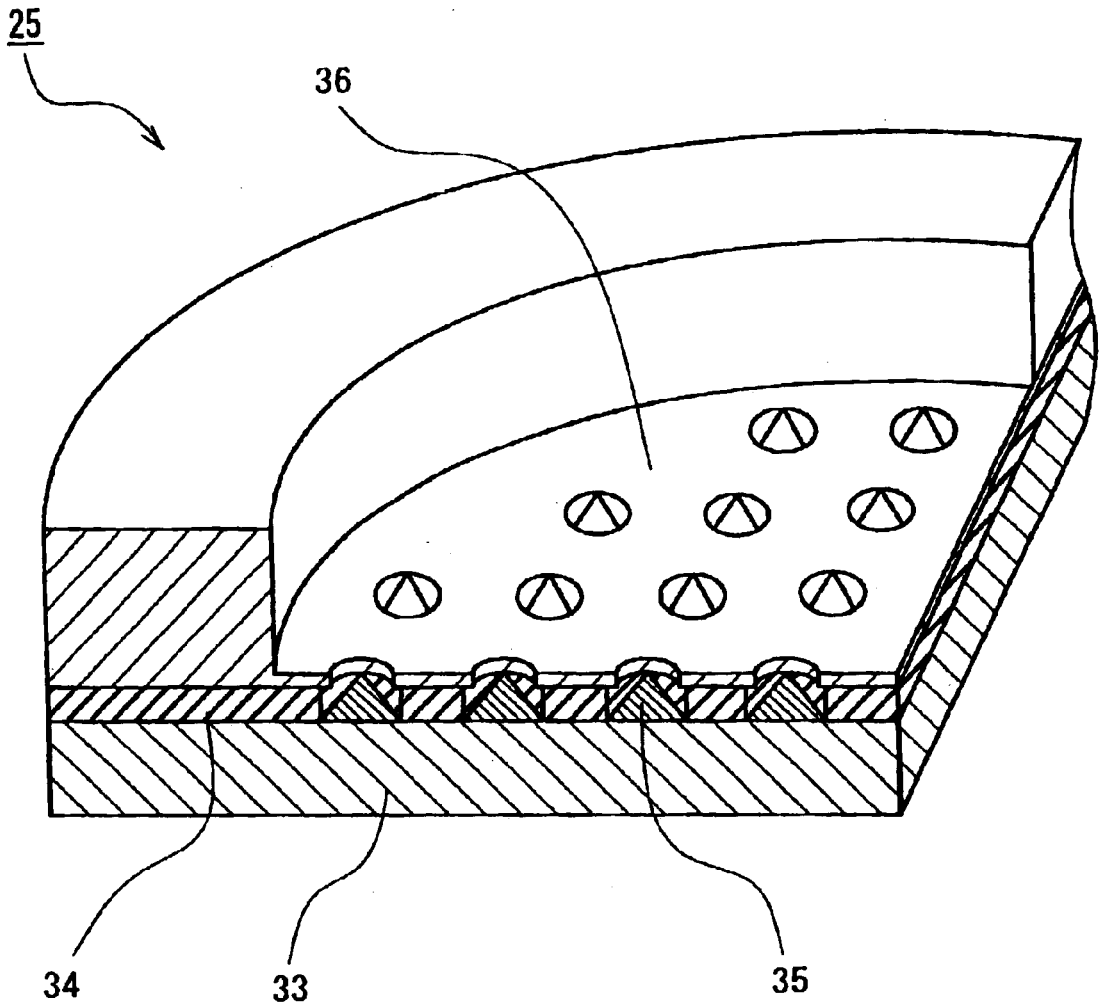
FIG. 9 PRIOR ART
FIG. 9 is a perspective sectional view showing a field-emission cold cathode in the conventional technology.

FIG. 7 shows a schematic configuration of the cathode 37 in the present embodiment. As shown in this figure, the surface of the lead electrode 17 is formed into a cylindrical shape that is bent along a horizontal direction. The cathode 37 has an outer shape of 2 mm×2 mm, an emitter region with a dimension of 1.0 mm×0.2 mm, and a surface with a radius of curvature along the horizontal direction of 10 mm.

Since the surface of the lead electrode 17 is formed into the cylindrical shape as described above, wrinkles or displacements do not occur easily when the substrates 13 and 14 are attached to each other during a manufacture of the cathode 37. Accordingly, the cathode 37 can be manufactured accurately and easily.

Furthermore, because the cylindrical surface is bent along the horizontal direction, the shape of the beam spot on the phosphor screen is shortened only in the horizontal direction and becomes vertically elongated, so that less color displacements are caused in a picture tube having a striped phosphor screen. Thus, this cylindrical surface bent along the horizontal direction can be applied to a so-called beam index system color picture tube, which has a phosphor pattern for signal detection on the striped phosphor screen and has no shadow mask.

The radius of curvature of the surface of the lead electrode 17 also may be made smaller from the center of the lead electrode 17 toward the periphery thereof along the horizontal direction.

As described above, the surface of the lead electrode 17 of the present invention macroscopically has a curved shape that is convex in the electron emission direction. On the other hand, microscopically, it also may be smooth or provided with minute unevenness. For example, a protrusion for reinforcement may be formed in a region between the apertures surrounding the electron-emitting electrodes 15, or the rim of the aperture may protrude in the electron emission direction like a caldera.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A picture tube device comprising:

a field-emission cold cathode comprising:

a plurality of electron-emitting cathodes, and a lead electrode provided with a plurality of apertures surrounding the plurality of electron-emitting cathodes respectively, wherein electrons emitted from the plurality of electron-emitting cathodes form a single electron beam flux;

a main lens for focusing the electron beam flux; and a phosphor screen on which the electron beam flux focused by the main lens impacts so as to form a beam spot;

wherein a surface of the lead electrode has a curved shape that is convex in an electron emission direction.

2. The picture tube device according to claim 1, wherein the surface of the lead electrode is a part of a substantially spherical surface.

3. The picture tube device according to claim 1, wherein a radius of curvature of the surface of the lead electrode in at least one direction selected from a vertical direction and a horizontal direction is made substantially constant.

4. The picture tube device according to claim 1, wherein a radius of curvature of the surface of the lead electrode in at least one direction selected from a vertical direction and a horizontal direction is made smaller from a center or the surface of the lead electrode toward a periphery thereof.

5. The picture tube device according to claim 1, wherein the surface of the lead electrode is a part of a cylindrical surface.

6. The picture tube device according to claim 5, wherein the cylindrical surface has a cylindrical shape that is bent along a horizontal direction.

* * * * *